US007318712B2

(12) United States Patent
Arnold

(10) Patent No.: US 7,318,712 B2
(45) Date of Patent: Jan. 15, 2008

(54) ROTARY PISTON MACHINES COMPRISING A DISPLACEABLE INNER HOUSING

(75) Inventor: Felix Arnold, Stuttgart (DE)

(73) Assignee: COR Pumps + Compressors AG, Stuttgart (DE)

( * ) Notice: Subject to any disclaimer, the term of this patent is extended or adjusted under 35 U.S.C. 154(b) by 237 days.

(21) Appl. No.: 10/522,960

(22) PCT Filed: Aug. 4, 2003

(86) PCT No.: PCT/DE03/02632

§ 371 (c)(1),
(2), (4) Date: Apr. 6, 2005

(87) PCT Pub. No.: WO2004/015245

PCT Pub. Date: Feb. 19, 2004

(65) Prior Publication Data

US 2005/0175493 A1 Aug. 11, 2005

(30) Foreign Application Priority Data

Aug. 2, 2002 (DE) ..... 102 35 604

(51) Int. Cl.
*F03C 2/00* (2006.01)
*F04C 18/00* (2006.01)

(52) U.S. Cl. ..... 418/195; 418/68; 418/104; 418/144; 123/230; 123/221

(58) Field of Classification Search ..... 418/68, 418/104, 144, 193, 195; 123/230, 221, 228, 123/241

See application file for complete search history.

(56) References Cited

U.S. PATENT DOCUMENTS

| | | | | |
|---|---|---|---|---|
| 2,662,482 | A * | 12/1953 | Paulsmeier et al. | 418/68 |
| 2,831,436 | A * | 4/1958 | Schmidt et al. | 418/195 |
| 3,101,700 | A * | 8/1963 | Bowdish | 418/195 |
| 3,816,038 | A | 6/1974 | Berry | |
| 3,856,440 | A | 12/1974 | Wildhaber | |
| 6,032,636 | A * | 3/2000 | Kajino | 418/68 |

FOREIGN PATENT DOCUMENTS

| | | |
|---|---|---|
| DE | 42 41 320 | 6/1993 |
| DE | 198 37 729 | 5/1999 |
| GB | 1 472 291 | 5/1977 |

* cited by examiner

*Primary Examiner*—Theresa Trieu
(74) *Attorney, Agent, or Firm*—Jordan and Hamburg LLP

(57) ABSTRACT

In a rotary piston machine with an inner housing and rotors, the axes of the rotors are disposed at an angle to one another in order to equalize manufacturing tolerances and to reduce gap losses of such machines.

9 Claims, 1 Drawing Sheet

ROTARY PISTON MACHINES COMPRISING A DISPLACEABLE INNER HOUSING

BACKGROUND OF THE INVENTION

The invention relates to a rotary piston machine. The manufacture of rotary piston machines with power parts and shut-off parts with axes arranged at an angle to one another is known. For these, the rotors, at least one power part and one shut-off part occupy a spherical volume (DE 42 41 320 C2) or correspond to the volume of a spherical washer (198 37 729 A1).

However, such machines have the disadvantage that, especially when the overall dimensions become smaller, the gap losses between the regions in the interior of such machines, which are acted upon with different pressures and can be used as pumps or motors, increase and, due to methods such as the manufacture of components with lower tolerances, there is a disproportionate increase in the manufacturing costs for producing precise, meshing rotors and the associated housing, as a result of which the necessary expense for centering the rotors relative to one another increases exponentially and it is not possible to reduce these gap losses at economically justifiable costs.

SUMMARY OF THE INVENTION

In comparison with the above, the inventive rotary piston machine has the advantage that, due to the arrangement of the inner housing, which can be shifted freely in the axial and radial directions, the inner housing is centered relative to the rotors, so that the dimensions of the gap between the components of the rotary piston machine, which can be moved relative to one another (power part, shut-off part, inner housing) and are arranged to form a seal, can be averaged, as a result of which the gap losses are reduced. This is achieved owing to the fact that the rotors, which have a spherical external shape and are centered, on the one hand, by a shaft, for example, the drive shaft of a motor (power part) that is flanged to the rotary piston machine and, on the other, the control head of the rotary piston machine (shut-off part), are surrounded by an inner housing with a spherical recess. With a cylindrical borehole, which goes over into the spherical recess, the inner housing freely movably takes up the rotor, the rotor being centered on the shank of the control head. The spherical recess is to accommodate the one rotor, which is disposed on shank and engages the other rotor, seated on the shank of the control head, at an axial angle. An opening in the spherical part of the inner housing permits the shaft, as well as the shank of the rotor (power part) fastened thereon, to be passed through. In addition, the inner housing is prevented from backing away from the control head, for example, by a cone, which surrounds the shank of the rotor rotating with the shaft, and prevented from rotating along by a protection against torsion, which can be shifted freely in the axial and radial directions, for example, by springs, which are disposed on the outside of the inner housing and engage recesses at the outer housing. Pressure equalization between the inside and the outside of the inner housing is produced through openings over a portion of the periphery at the inner housing which, depending on the type of operation, function as an inlet or an outlet of the conveying or driving fluid, so that the pressure between the inner housing and the housing is the same as that within the inner housing and that the pressure between the housing and the inner housing is higher than the static pressure in the gap between the outer circumferential surface of the rotors and of the inner surface of the inner housing during developing flow through the gap, so that, by these means, an additional sealing action is achieved, in that the inner housing is pressed all around on the rotors by the resulting pressure forces.

In accordance with a further advantageous development of the invention, the rotors and the inner housing surrounding the rotors can be pressed against one another in the axial direction, for example over an adjusting ring and a spring lock washer, so that the amount of fluid flowing through the gaps between the individual chambers formed by the rotors and between the rotor, lying in the spherical recess, and the inner housing, can additionally be reduced.

Further advantageous developments of the invention can be inferred from the following description of an example, the drawing and the claims.

An example of the invention is shown in the drawing and explained in greater detail in the following.

BRIEF DESCRIPTION OF THE DRAWING

Accompanying the specification is a single Figure illustrating a cross sectional view of a rotary piston machine according to one embodiment of the invention.

DETAILED DESCRIPTION OF THE INVENTION

Figure 1:
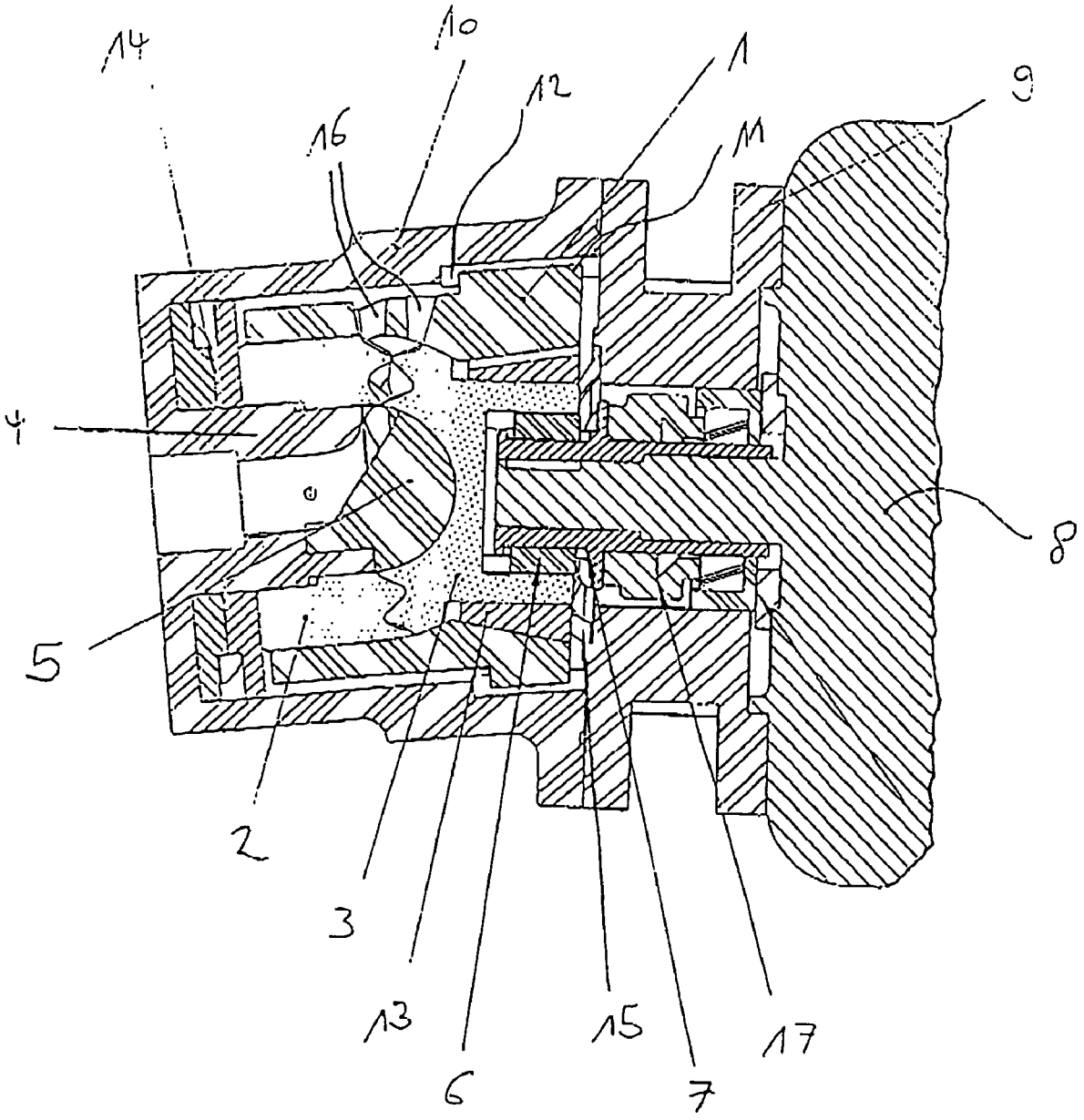

The rotors of a rotary piston machine, the shut-off part 2 and the power part 3, engage one another at an axial angle, so that chambers are formed between the shut-off part 2 and the power part 3. The chambers have volumes variable over the angle of rotation for conveying fluids or gases.

With a borehole accommodating the shank 4 of the control head 5, the shut-off part 2 is disposed rotatably about the longitudinal axis of the shank 4. On the side facing the shut-off part 2, the power part 3 has a central, spherical recess for accommodating the control head 5.

By means of an adjusting spring 6 and a shaft extension 7, the shank of the power part 3 is fastened on the shaft of a motor 8. The housing 10 is fastened to the motor 8 over a flange 9.

The two rotors (shut-off part 2 and power part 3), which are fixed in their position by the shank 4 of the control head 5 and the shaft of the motor 8, are surrounded by an inner housing 1. The inner housing 1 can be shifted in the axial and radial directions and has a central borehole. The central borehole of the inner housing 1 goes over into a spherical recess, for accommodating the rotors (shut-off part 2 and power part 3).

In order to prevent the inner housing 1 from rotating along, springs 11, which engage recesses 12 at the housing 10, are formed at the outside of the inner housing 1. The recesses 12 are disposed between an inner surface of the housing 10 and the outer surface of the inner housing 1. The recesses 12 and the springs 11 together define first structural and biasing means.

Above the shank of the power part 3, a cone 13 is disposed. The cone 13 defines second structural means for preventing movement of the inner housing 1 away from the control head 5.

The shut-off part 2, the power part 3 and the inner housing 1 are pressed against one another in an axial direction. The extent of the precessing is effected by adjusting rings 14 and a split washer 15. The adjusting rings 14 define second biasing means and the split washer 15 defines third biasing means.

Due to the free displaceability of the inner housing 1 relative to the rotors 2 and 3, manufacturing tolerances of the sub-assembly as a whole, especially of the shut-off part 2 and the power part 3 are averaged. As a result, gap flows are reduced.

The operating pressure of the rotary piston machine in the space between the housing 10 and the inner housing 1 is transferred through at least one pressure passage 16 into the inner housing 1 (the example of FIG. 1 depicting two said pressure passages 16). By these means, an additional force is produced, with which the inner housing 1 is pressed in the radial and axial directions against the shut-off part 2 and the power part 3.

In order to prevent loss of conveying fluid from the housing 10, a mechanical seal 17 is disposed between the flange 9 and the shaft of the motor 8.

All the distinguishing features, given in the specification, the following claims and the drawing, may be essential to the invention individually as well as in any combination.

The invention claimed is:

1. A rotary piston machine including:

first and second rotors being mutually disposed at an axial angle, said first rotor engaging said second rotor such that chambers are formed between said first and second rotors for conveying fluids or gases, said second rotor having a shank, said shank engaging a motor shaft;

a housing including an inner surface;

an inner housing including an outer surface spaced from said inner surface of said housing thereby forming a space therebetween, said inner housing further including a cylindrical borehole in which said rotors are accommodated, said borehole including a spherical recess having an opening through which said shank of said second rotor passes for engaging said motor shaft, said inner housing being shiftable, relative to the rotors, in axial and radial directions;

first structural and biasing means for urging said inner housing against rotation within said housing;

second structural means for preventing movement of the inner housing in the axial direction away from the rotors; and said inner housing including at least one pressure passage for transferring operating pressure in said space between the outer surface of the inner housing and the inner surface of the housing into the inner housing for producing contacting pressure between the inner housing and the rotors for minimizing gap flows.

2. The rotary piston machine of claim 1, further comprising:

second biasing means for moving said rotors axially towards a motor; and third biasing means for limiting movement of said rotors axially towards said motor.

3. The machine of claim 2 wherein the second biasing means comprises adjusting rings.

4. The machine of claim 2 wherein the third biasing means comprises a split washer.

5. The machine of claim 1 wherein said first structural and biasing means comprises:

a recesses disposed between said inner surface of the housing and said outer surface of the inner housing; and springs disposed on said outer surface of said inner housing, said springs engaging said recess.

6. The machine of claim 1 wherein the second structural means comprises a cone.

7. A rotary piston machine including:

first and second rotors mutually disposed at an axial angle, said first rotor engaging said second rotor such that chambers are formed between said first and second rotors for conveying fluids or gases;

an outer housing;

an inner housing including a cylindrical borehole having a recess, said rotors being disposed in said borehole, said recess having an opening through which said second rotor passes; and at least one pressure passage in said inner housing for transferring operating pressure exterior of the inner housing into the inner housing for producing contacting pressure between said inner housing and said rotors.

8. The machine of claim 7 wherein said inner housing is shiftable, relative to the rotors, in axial and radial directions.

9. The machine of claim 7 wherein said borehole recess is spherical.

* * * * *